US009222476B2

(12) United States Patent
Hanisch et al.

(10) Patent No.: US 9,222,476 B2
(45) Date of Patent: Dec. 29, 2015

(54) ROTARY PUMP WITH SPIRAL CASING

(75) Inventors: Enno Hanisch, Osnabrück (DE); Reinhard Henbrock, Hörstel (DE)

(73) Assignee: OASE GmbH, Hörstel-Riesenbeck (DE)

( * ) Notice: Subject to any disclaimer, the term of this patent is extended or adjusted under 35 U.S.C. 154(b) by 541 days.

(21) Appl. No.: 13/543,842

(22) Filed: Jul. 8, 2012

(65) Prior Publication Data

US 2013/0017077 A1 Jan. 17, 2013

(30) Foreign Application Priority Data

Jul. 13, 2011 (EP) ..... 11005738

(51) Int. Cl.
*F04D 29/42* (2006.01)
*F04D 15/00* (2006.01)

(52) U.S. Cl.
CPC ..... *F04D 15/0077* (2013.01); *F04D 29/426* (2013.01)

(58) Field of Classification Search
CPC ..... F04D 29/42; F04D 29/424; F04D 29/426; F04D 15/00; F04D 29/428; F04D 29/445
USPC ..... 415/203, 204, 205, 206, 214.1, 215.1, 415/196, 184; 417/423.3
See application file for complete search history.

(56) References Cited

U.S. PATENT DOCUMENTS 3,776,664 A * 12/1973 Kimmell ..... 417/243
2005/0254974 A1* 11/2005 Hoffmeier ..... 417/423.3
2010/0322761 A1* 12/2010 Hunjan et al. ..... 415/203

FOREIGN PATENT DOCUMENTS

DE 103 31 602 A1 3/2004

* cited by examiner

*Primary Examiner* — Edward Look
*Assistant Examiner* — Maxime Adjagbe
(74) *Attorney, Agent, or Firm* — Gudrun E. Huckett

(57) ABSTRACT

A rotary pump has a pump housing enclosing a flow space and provided with an intake opening and a discharge opening, wherein the intake opening and the discharge opening are connected to each other by the flow space. An impeller wheel is disposed in the flow space and is driven in rotation. An expansion body is provided that is fluidically connected to the flow space. A spiral casing surrounds, in a mounted position in the pump housing, an outer circumference of the impeller wheel, wherein the spiral casing is a single-part or multi-part shaped component and is embodied separate from the pump housing.

14 Claims, 3 Drawing Sheets

2
8
34
16
4
18
14
22
26
6
30
12
10
32
16
30
20
24
14
28
30

ROTARY PUMP WITH SPIRAL CASING

BACKGROUND OF THE INVENTION

The invention relates to a rotary pump with a pump housing that has an intake opening and a discharge opening that are connected to each other by means of a flow space arranged within the pump housing; an impeller wheel that is arranged in the flow space and can be driven in rotation; a spiral casing that surrounds the outer circumference of the impeller wheel; and an expansion body that is in fluidic communication with the flow space.

DE 103 31 602 A1 discloses a rotary pump provided with one or several expansion bodies in order to protect the shaft of the impeller wheel from frost damage. When the volume of the water contained in the flow space changes as a result of a temperature-caused phase change of the state of aggregation, the expansion body can change its form in a flexible way. In particular, bending forces and pressure acting on the pump housing or pump components when water freezes can be avoided when the expansion body is compressed as a result of increasing pressure in the pump housing and, in this way, the volume increase of the water can be compensated in the pump housing. For producing the expansion body, flexible and elastic materials can be employed, for example, rubber bladders, closed-pore foams of a flexible material, and the like.

A rotary pump is a fluid flow machine which, by means of a rotating impeller wheel, uses centrifugal force for conveying liquids. Liquid that enters the rotary pump through an intake socket is entrained by the rotating impeller wheel and first is forced on a circular path in outward direction. Accordingly, the liquid that is contained within the impeller wheel and entrained by the impeller wheel is caused to move and new liquid is sucked into the active area of the impeller wheel. When the flow of water through the rotary pump is impaired by installed parts, the degree of efficiency of the rotary pump is decreased.

In practice, it has been found to be difficult to integrate an expansion body into the pump housing without simultaneously decreasing the degree of efficiency of the pump. While it is possible to arrange the expansion body in the motor housing car, it is a problem that the motor housing must be as seal-tight as possible in order to prevent undesirable water entry with total loss of the motor. Therefore, it is advantageous to keep, if possible, the water away from the motor housing entirely and to dispose the expansion body in the pump housing. In the pump housing, the expansion body can however impair the water passage when it is not arranged optimally. Also, manufacture of a rotary pump of the aforementioned kind should be as inexpensive as possible without significant technical expenditure.

SUMMARY OF THE INVENTION

It is therefore an object of the present invention to propose a solution according to which in an inexpensive way with easy assembly the degree of efficiency of the impeller wheel can be increased without in this connection impairing the installation possibilities of an expansion body within the pump housing.

In accordance with the present invention, this is achieved in that the rotary pump has a spiral casing that surrounds the outer circumference of the impeller wheel and the spiral casing is embodied as a separate single-part or multi-part shaped component that is separate from the pump housing.

A circumferential wall that extends about the circumference of the impeller wheel in a spiral shape can improve the degree of efficiency of the impeller wheel used in the pump. In particular when the free cross-section of the flow passage between the outer circumference of the impeller wheel and the inwardly facing surface of the spiral casing increases in the conveying direction of the pumped water toward the discharge opening, an improved degree of efficiency can be achieved with the rotary pump.

By providing a separate shaped component that is separate from the pump housing, the shaped component can be designed more freely with respect to its shape. This is very advantageous in particular with respect to optimal adjustment to the shape of the impeller wheel. It is easier to design from the start, for example, an injection-molded part of plastic material with regard to its shape in optimized form than to after-machine in mass production each pump housing individually, respectively, so that an optimized shape relative to the impeller wheel results in the end. The separate shaped component can be designed such that the expansion body can be installed in the pump housing without impairing in the mounted state the flow of water through the impeller wheels. Moreover, it is possible to use in a uniform pump housing different impeller wheels with respectively matched spiral inserts without having to keep in stock various pump housings. Stocking of parts and a multitude of parts in production can thus be reduced. It is possible to produce and offer different rotary pumps with different characteristic lines by using a single pump housing, wherein the pumps differ only with regard to the shape of the spiral insert, the impeller wheel, and possibly additionally the motor configuration.

For improving the degree of efficiency of the rotary pump, it is without consequence whether the spiral casing is designed as a single-part or multi-part shaped component. A multi-part shaped component can be designed so as to be easily assembled by fitting together the parts so that no significantly increased assembly expenditure results. However, the simplest solution resides in providing a shaped component that is of a single-part configuration.

According to one embodiment of the invention, in mounted position in the pump housing, the spiral casing is connected to the pump housing in a frictional and/or form-fit connection. In case of a frictional connection, for example, by clamping, assembly is possible without requiring tools and is therefore easy. In case of a form-fit connection, the spiral casing is secured by its shape in its mounted position. By projections on the lateral circumference, the spiral casing can be prevented from changing its mounted position in the rotational direction of the impeller wheel during the course of use of the rotary pump. Axial movements along the rotation axis of the impeller wheel can be avoided when the constructive height of the spiral casing is matched precisely to the dimensions of the flow space and the spiral casing is supported on the inner wall of the pump housing in the mounted position. In this connection, mounting is also possible without tools and thus can be carried out quickly and efficiently in that the spiral casing for assembly of the rotary pump must only be placed into the pump housing before the latter is connected to the motor housing. The frictional and form-fit connecting technique can also be combined with each other in order to secure a spiral casing in the pump housing in the mounted position. The proposed connecting techniques are also easily detachable in case of repair work.

According to one embodiment of the invention, the expansion body is arranged in the pump housing in a receptacle that adjoins the flow space and the expansion body is separated from the flow space by a wall of the spiral casing. By arrangement of the expansion body outside of the flow space an unimpaired water flow through the flow space is ensured. The flow space can be designed optimally with regard to fluid mechanics without having to take into account the expansion body. Since the spiral casing delimits the flow space, an additional wall is not needed when a wall of the spiral casing at the same time forms the boundary to the mounting space (receptacle) of the expansion body.

According to one embodiment of the invention, the expansion body is secured by the wall in its mounted position. By this design mounting of the pump is simplified. In order to assemble the rotary pump, the expansion body must only be placed into the pump housing in order to then place the spiral casing thereon and to connect the pump housing with the motor housing.

According to one embodiment of the invention, the shaped component of the spiral casing embodied in a single-part or multi-part configuration delimits in its mounted position flow-through openings that fluidically connect the expansion body with the flow space. The flow-through openings can be formed exclusively in a wall of the shaped component, for example, as holes or slots; however, this may cause disruptions in the flow behavior of the water as it passes through the flow space. However, it is also possible to design the flow-through openings by means of gaps that are formed by the spiral casing together with a wall of the pump housing. Since the spiral casing as a result of unavoidable tolerances cannot be placed seal-tightly against the inner surfaces of the pump housing, in this configuration the gap dimension between a component edge of the spiral casing and the adjoining surface of the pump housing is widened such that, taking into account the possible tolerances, there is always a sufficiently large flow-through opening through which pressure compensation between the flowspace and the expansion body is possible in order to avoid damage on components of the pump by freezing water. A particularly fluidically beneficial position of the passage gap is in the abutment area of the spiral casing at the intake socket or the intake opening because here the flow conditions of the water are impaired only minimally.

According to one embodiment of the invention, the spiral casing has on its exterior side that is facing away from the impeller wheel one or several projections with which the spiral casing is supported in its mounted position on the pump housing in a self-aligning arrangement. The spiral casing must be mounted in the pump housing such that the impeller wheel upon rotational movement will not collide with or drag on the surfaces of the spiral casing. Also, the predetermined size of the free cross-section of the flow passage delimited by the outer circumference of the impeller wheel and the inner surface of the spiral casing must be maintained in order to achieve an optimal efficiency of the pump. Accordingly, a centering action of the spiral casing in its mounted position relative to the axis of rotation of the impeller wheel is required. This centering action can be effected by means of projections that are arranged on opposed sides of the spiral casing relative to the axis of rotation of the impeller wheel. When the projections in their mounted position are supported on the pump housing, in particular with a force component transversely to the axis of rotation of the impeller wheel, the projections by means of the support forces provide a force balance in which the spiral casing is secured in its nominal assembly position in a position that is properly centered relative to the axis of the impeller wheel.

According to one embodiment of the invention, the intake opening is connected with the flow space by means of an intake socket and the expansion body is embodied as an annular component that surrounds the intake socket at its outer circumference. By means of the intake socket, the mounting space that is required for the expansion body can be spanned. The intake socket spans a conveying stretch for incoming water from the intake opening to the impeller wheel. The intake socket is a component integrated into the pump housing or a separate component that is inserted into the pump housing. The length of the intake socket can be used to improve the inflow behavior of the water into the rotary pump. The distance that the water that is sucked in by the pump travels through the intake socket causes the flow in this area to become rectified. Turbulent flows that might impair the desirably unhindered flow of water are thus reduced or completely avoided. By inflow against the impeller wheel from the intake socket instead of directly from the intake opening, the water flows more uniformly into the impeller wheel so that efficiency losses are reduced. With the annular configuration of the expansion body the intake socket can extend centrally through the expansion body and can also be centrally oriented relative to the impeller wheel. The expansion body with regard to its shape and position can be matched completely to the shape and position of the impeller wheel so that a compensation possibility for pressure differences caused by phase changes is provided independent of location and advance of freezing of the water within the pump housing.

According to one embodiment of the invention, an inflow funnel is inserted into the intake socket; the inflow funnel is a single-part or multi-part shaped component that is connected with the pump housing by frictional and/or form-fit connection in the installed position in the intake socket. By means of a separate intake funnel, the flow behavior of the water in the area of the intake socket can be even more improved and matched to the flow characteristics of the respective impeller wheel. By means of the funnel shape, it is in particular possible to improve the inflow behavior of the water into the intake opening and to reduce, or avoid completely, flow swirls which occur in the vicinity before or in the area of the intake opening. Because of the frictional and/or form-fit connection the shaped component can be easily mounted. Depending on the employed impeller wheel, it is also possible to employ in an identical pump housing one of several different impeller wheels and one of several different inflow funnels matched to the impeller wheel, respectively, so that a modular system of different components for configuring a rotary pump is provided.

According to one embodiment of the invention, the inflow funnel has an outer circumferential surface with contact surfaces by means of which the inflow funnel in its mounted position is supported on the pump housing in a self-aligning arrangement. The self-aligning support of the inflow funnel has the same various advantages as they have been explained above already in connection with the self-lining support of the spiral casing.

It is expressly noted that the afore described embodiments of the invention taken alone, but also combined with each other in different combinations, may be useful for configuring the invention as claimed in the independent claim. This also applies to the combination of individual technical features that have been described in connection with one embodiment with individual technical features of a different embodiment, inasmuch as such combination appears technically expedient.

DESCRIPTION OF THE PREFERRED EMBODIMENTS

Figure 1:
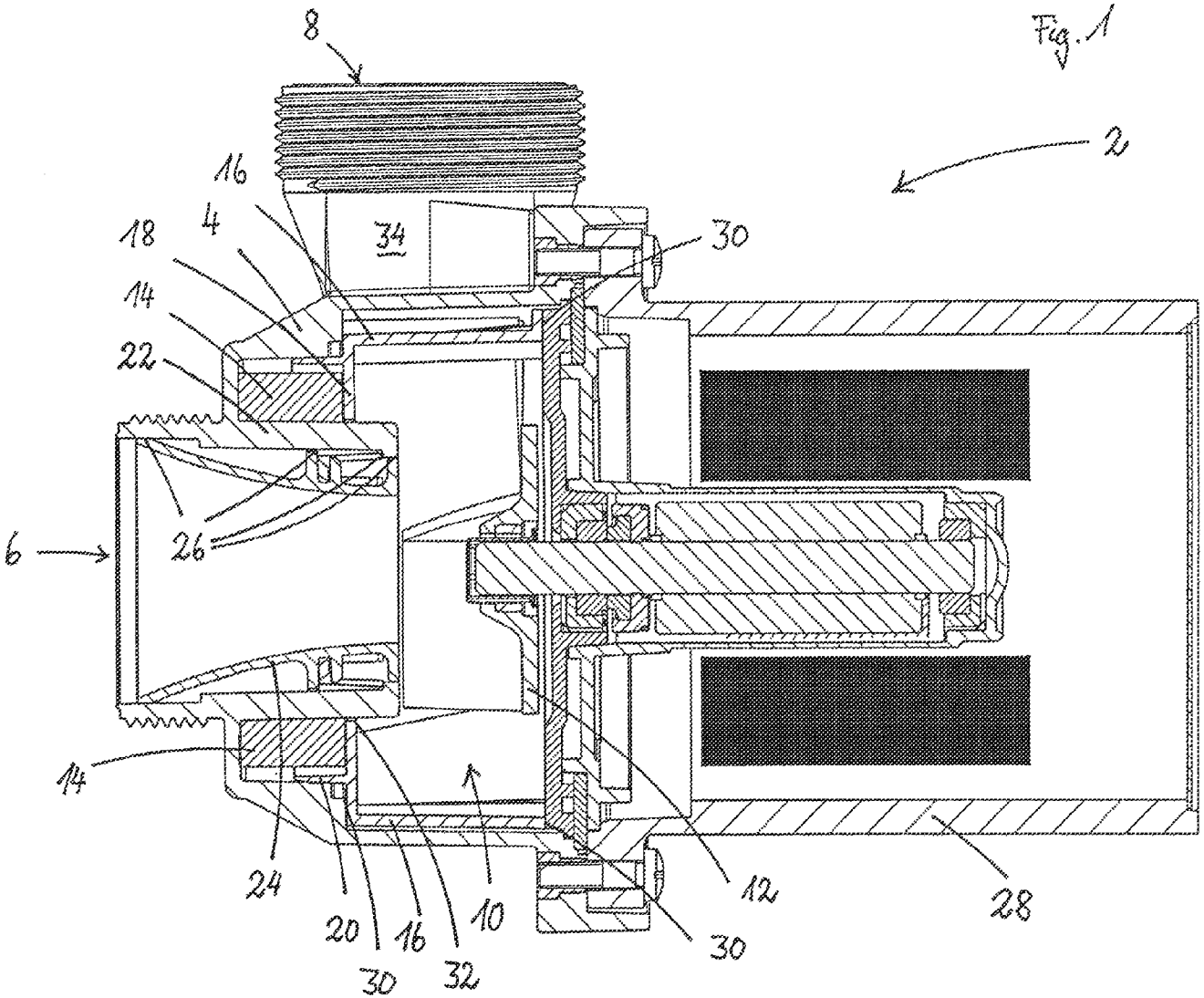
FIG. 1 is a cross-sectional view of a rotary pump.

FIG. 1 shows a rotary pump 2 with a pump housing 4. The pump housing 4 has an intake opening 6 and a discharge opening 8. The intake opening 6 and the discharge opening 8 are fluidically connected with each other by a flow space 10 in which the impeller wheel 12 is arranged. When the rotary pump 2 is operating, water flows through the intake opening 6 into the flow space 10, is accelerated therein by the rotating impeller wheel 12, and is forced out through the discharge opening 8 from the rotary pump 2.

Laterally spaced from the impeller wheel 12, an expansion body 14 is arranged in the pump housing 4 and is separated in the illustrated embodiment from the impeller wheel 12 by a spiral casing 16. The spiral casing 16 has a wall 18 by means of which the expansion body 14 is secured in its mounted position. At the same time, the wall 18 delimits a flow space 10 and the impeller wheel 12.

The spiral casing 16 has on its exterior side a projection 20 that is supported in a clamping fashion on the inner surface of the pump housing 4 and that centers thereby the spiral casing 16 in its mounted position. The projection 20 is designed in the illustrated embodiment as a circumferentially extending ring.

In the illustrated embodiment, in the pump housing 4 an intake socket 22 is formed that connects as a flow passage the intake opening 6 with the flow space 10. An inflow funnel 24 is inserted into the intake socket 22 and has a flow cross-section that decreases in the flow direction. The inflow funnel 24 contacts by means of contact surfaces 26 the inner surface of the pump housing 4.

In the assembled situation of the rotary pump 2 illustrated in FIG. 1, the spiral casing 16 is designed as a single-part shaped component. The dimensions of the spiral casing 16 are selected such that the spiral casing 16 is positioned without play in the flow space 10 when the pump casing 4 is attached to the motor housing 28. Here, the spiral casing 16 is secured in its mounted position because its dimensions are matched to and fit the inner dimensions of the pump housing 4. In the illustrated embodiment, the positional fixation of the spiral casing 16 is in particular caused by the contact surfaces 30 formed on the spiral casing 16.

In the illustrated embodiment, in the abutment area of the wall 18 on the intake socket 22, a passage gap 32 is formed that surrounds the intake socket 22 and extends circumferentially about the intake socket 22. The passage gap 32 forms a flow opening through which the water from the flow space 10 can penetrate into the receptacle in which the expansion body 14 is located when the water in the flow space 10 expands with respect to its volume as a result of a phase change. Because of its flexible configuration, the expansion body 14 is compressed by the incoming water and partially displaced. When the water that has been transformed to ice thaws again and the volume of the water in the flow space 10 is reduced again, the water that is contained in the area of the expansion body 14 can flow back through the passage gap 32 into the flow space 10. In this way, the circular pump 2 is protected from possible frost damage.

Figure 2:
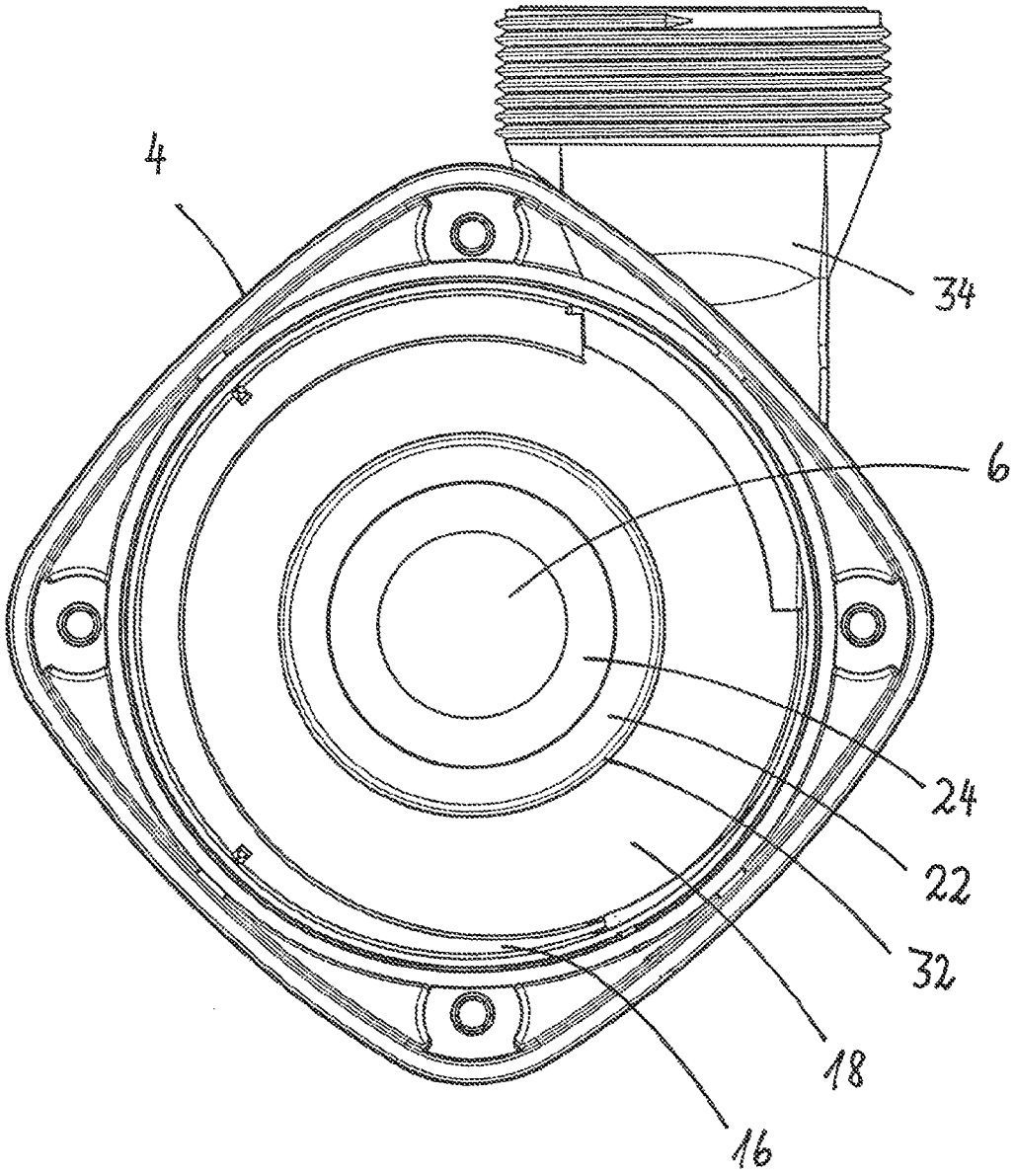
FIG. 2 is an end view of the pump housing.

In FIG. 2, a front end view of the open pump housing 4 is illustrated. The spiral casing 16 is inserted into the pump housing 4. In the front end view it can be seen clearly that the wall 18 of the spiral casing 16 in the area where it abuts the intake socket 22 forms an annular passage gap 32 as a result of appropriate dimensional configuration. Also, the end face of the inflow funnel 24 at the impeller side can be seen by means of which the free flow cross-section of the intake socket 22 is reduced. A pressure socket 34 is formed on the pump housing 4 by means of which the water is conveyed from the flow space 10 to the discharge opening 8.

Figure 3:
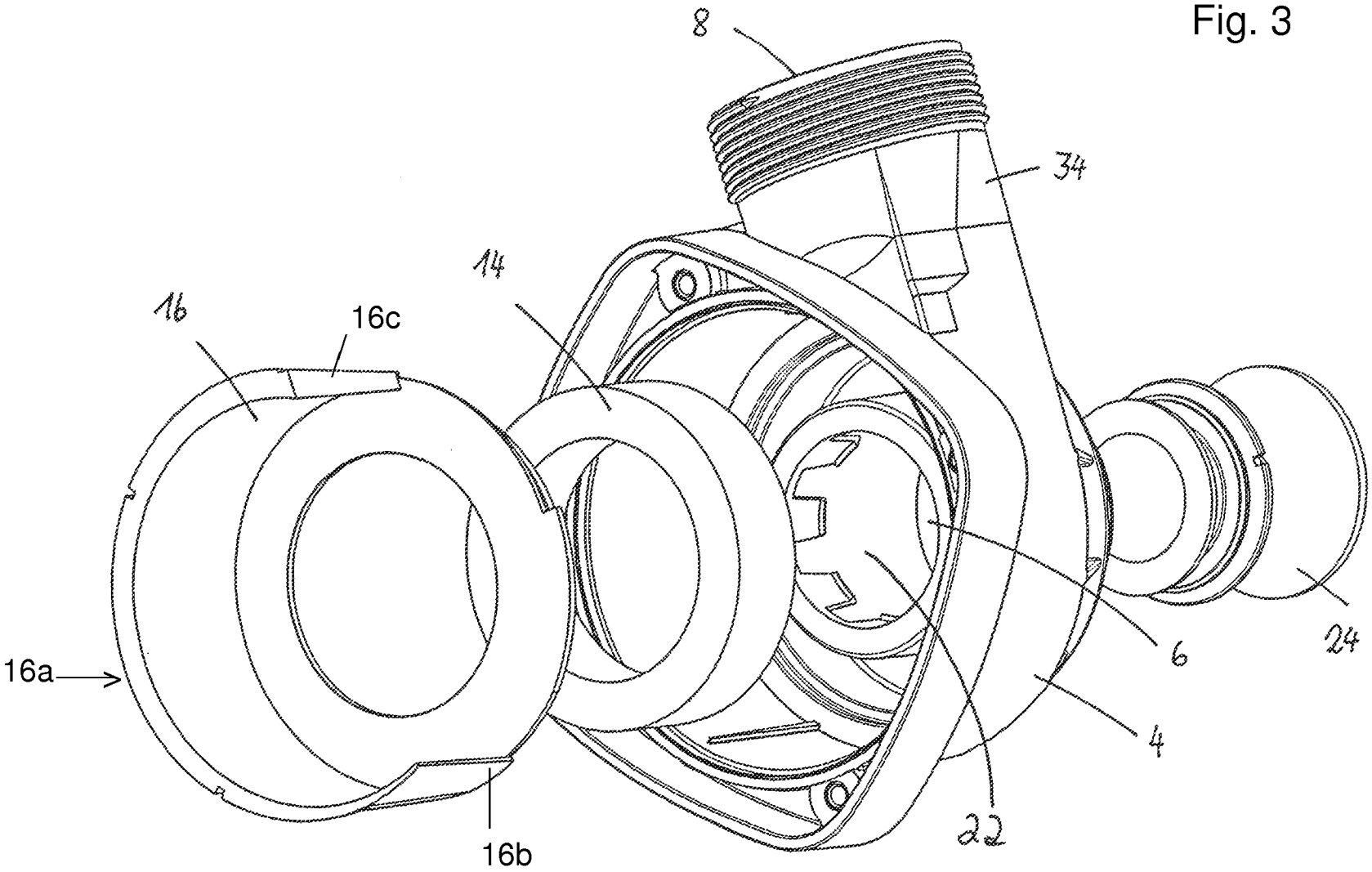
FIG. 3 is an exploded view of the pump housing of FIG. 2.

In FIG. 3, an exploded view of the individual components inserted into the pump housing 4 is shown. At the side of the flow space 10, the expansion body 14 and the spiral casing 16 are insertable into the pump housing 4. The spiral casing 16 comprises a circumferentially extending wall **16*a* with a first circumferential end 16*b* and a second circumferential end 16*c* opposite the first circumferential end 16*b* and a circumferential length extending from the first circumferential end 16*b* to the second circumferential end 16*c*. At the side of the intake opening 6, the inflow funnel 24 is illustrated which is insertable into the intake socket 22. In place of the illustrated components for the spiral casing 16 and the inflow funnel 24 as shown in FIG. 3, components of a different shape can be inserted into the pump housing 4 that are matched to a different shape of the impeller wheel 12. Because of the possibility of inserting into the pump housing 4 differently shaped components as a spiral casing 16 and/or an inflow funnel 24, the pump housing 4 can be adapted easily to different impeller wheels 12** and their special performance characteristics.

The invention is not limited to the afore described embodiment. A person of skill in the art will be able to easily adapt the illustrated embodiment to the technical requirements of a concrete application situation in a way that appears suitable to the skilled person. The above specification serves only for explaining the present invention.

The specification incorporates by reference the entire disclosure of European priority document 11 005 738.7 having a filing date of Jul. 13, 2011.

While specific embodiments of the invention have been shown and described in detail to illustrate the inventive principles, it will be understood that the invention may be embodied otherwise without departing from such principles.

What is claimed is:

1. A rotary pump comprising:

a pump housing comprising a circumferential inner wall enclosing a flow space, the pump housing provided with an intake opening and a discharge opening that is connected to the circumferential wall, wherein the intake opening and the discharge opening are connected to each other by the flow space;

an impeller wheel disposed in the flow space and configured to be driven in rotation;

an expansion body fluidically connected to the flow space;

a spiral casing embodied separate from the pump housing, the spiral casing mounted inside the flow space of the pump housing and surrounding an outer circumference of the impeller wheel;

wherein the spiral casing comprises a circumferentially extending wall comprising a first circumferential end and a second circumferential end opposite the first circumferential end, wherein the circumferential wall has a circumferential length measured from the first circumferential end to the second circumferential end, wherein the spiral casing is configured such that a free cross-section of a flow passage, defined between the outer circumference of the impeller wheel and an inwardly facing surface of the circumferentially extending wall of the spiral casing, increases continuously in the circumferential direction across said circumferential length in a conveying direction toward the discharge opening, wherein the spiral casing is a single-part or multi-part shaped component.

2. The rotary pump according to claim 1, wherein the spiral casing in the mounted position in the pump housing is frictionally and form-fittingly connected to the pump housing.

3. The rotary pump according to claim 1, wherein the spiral casing in the mounted position in the pump housing is frictionally connected to the pump housing.

4. The rotary pump according to claim 1, wherein the spiral casing in the mounted position in the pump housing is form-fittingly connected to the pump housing.

5. The rotary pump according to claim 1, wherein the pump housing has a receptacle adjoining the flow space and wherein the expansion body is arranged in the receptacle, wherein the spiral casing has a wall that separates the expansion body from the flow space.

6. The rotary pump according to claim 5, wherein the expansion body is secured by the wall of the spiral casing in the mounted position in the pump housing.

7. The rotary pump according to claim 1, wherein the spiral casing delimits flow-through openings connecting fluidically the expansion body with the flow space.

8. The rotary pump according to claim 1, wherein the spiral casing has an exterior side that is facing away from the impeller wheel and the exterior side has one or several projections with which the spiral casing in the mounted position in the pump housing is supported on the pump housing in a self-aligning arrangement.

9. The rotary pump according to claim 1, comprising an intake socket, wherein the intake opening is connected with the flow space through the intake socket and wherein the expansion body is designed as an annular component that surrounds an outer circumference of the intake socket.

10. The rotary pump according to claim 9, comprising an intake funnel arranged in the intake socket wherein the intake funnel is a single-part or multi-part shaped component.

11. The rotary pump according to claim 10, wherein the intake funnel, in an installed position in the intake socket, is connected with the pump housing by a frictional and form-fit connection.

12. The rotary pump according to claim 10, wherein the intake funnel, in an installed position in the intake socket, is connected with the pump housing by a frictional connection.

13. The rotary pump according to claim 10, wherein the intake funnel, in an installed position in the intake socket, is connected with the pump housing by a form-fit connection.

14. The rotary pump according to claim 10, wherein the intake funnel has an outer circumferential surface provided with contact surfaces and the contact surfaces, in an installed position of the inflow funnel in the intake socket, support the intake funnel on the pump housing in a self-aligning arrangement.

* * * * *